US010073373B2

(12) United States Patent
Shimizu et al.

(10) Patent No.: US 10,073,373 B2
(45) Date of Patent: Sep. 11, 2018

(54) IMAGE FORMING APPARATUS AND IMAGE FORMING METHOD THAT ENSURE IMPROVED MEASUREMENT SENSITIVITY OF PATCH DENSITY WITH OPTICAL SENSOR, AND RECORDING MEDIUM THEREFOR

(71) Applicant: Kyocera Document Solutions Inc., Osaka (JP)

(72) Inventors: Yoshimi Shimizu, Osaka (JP); Yukari Ota, Osaka (JP)

(73) Assignee: Kyocera Documents Solutions Inc., Osaka (JP)

( * ) Notice: Subject to any disclaimer, the term of this patent is extended or adjusted under 35 U.S.C. 154(b) by 0 days.

(21) Appl. No.: 15/646,355

(22) Filed: Jul. 11, 2017

(65) Prior Publication Data

US 2018/0011417 A1 Jan. 11, 2018

(30) Foreign Application Priority Data

Jul. 11, 2016 (JP) ..... 2016-137196

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS 8,073,353 B2 * 12/2011 Murayama ..... H04N 1/58 399/301
2008/0019740 A1 * 1/2008 Oouchi ..... G03G 15/0131 399/301
2008/0206661 A1 * 8/2008 Fujishima ..... G03G 15/0808 430/48
2010/0272457 A1 * 10/2010 Mabuchi ..... G03G 15/5041 399/49
2017/0038720 A1 * 2/2017 Hirai ..... G03G 15/5058

FOREIGN PATENT DOCUMENTS

JP H10-039654 A 2/1998
JP 2011-158837 A 8/2011

* cited by examiner

*Primary Examiner* — G. M. Hyder
(74) *Attorney, Agent, or Firm* — James Judge

(57) ABSTRACT

An image forming apparatus includes a photoreceptor, an exposure unit, a developing unit, and a control unit. The control unit sets the toner-layer-forming electric potential difference lower than an electric potential when forming the image on the print medium, forms a combined patch for calibration by the set toner-layer-forming electric potential difference for calibration, so as to adjust the developing-bias potential by measuring a print density of the formed combined patch. The combined patch includes a first patch and a plurality of second patches. The plurality of second patches have a width within a range of 0.2 mm to the predetermined value in the peripheral-velocity direction of the photoreceptor, extend with a length equal to or more than the predetermined value in the rotation-shaft direction of the photoreceptor, and are arranged at a predetermined interval in the peripheral-velocity direction of the photoreceptor.

9 Claims, 9 Drawing Sheets

IMAGE FORMING APPARATUS AND IMAGE FORMING METHOD THAT ENSURE IMPROVED MEASUREMENT SENSITIVITY OF PATCH DENSITY WITH OPTICAL SENSOR, AND RECORDING MEDIUM THEREFOR

INCORPORATION BY REFERENCE

This application is based upon, and claims the benefit of priority from, corresponding Japanese Patent Application No. 2016-137196 filed in the Japan Patent Office on Jul. 11, 2016, the entire contents of which are incorporated herein by reference.

BACKGROUND

Unless otherwise indicated herein, the description in this section is not prior art to the claims in this application and is not admitted to be prior art by inclusion in this section.

To ensure accurate color reproduction, there is proposed a technique that prints color patches, detects the printed color patches by a sensor, and then calibrates an image formation process. As a technique related to this, there is proposed a technique that uses a ladder patch as a color patch. The ladder patch has a plurality of thin, line-shaped patches, which are adjacently arranged. Assuming that print densities of respective straight-line portions of the ladder patch are identical to the print density of a solid patch, the technique enables detection in a print density region (a region with a large reflection-light amount by a combination with a background portion) where a detection sensitivity of an optical sensor is high. On the other hand, there is also proposed a technique that reduces generation of a transfer scattering (diffusion of toner to an outside of an image range) caused by edge effect, by reducing toner attachment amount in a contour portion of a toner image due to image processing or an adjustment of a gap.

SUMMARY

An image forming apparatus according to one aspect of the disclosure forms an image on a print medium. The image forming apparatus includes a photoreceptor, an exposure unit, a developing unit, and a control unit. The exposure unit exposes the photoreceptor to form an electrostatic latent image. The developing unit includes a magnetic roller and a development roller, forms a toner layer with a thickness corresponding to a toner-layer-forming electric potential difference between the magnetic roller and the development roller on the development roller, so as to attach a toner to the photoreceptor from the toner layer based on a developing-bias potential as an electric potential of the development roller and the electrostatic latent image. The control unit sets the toner-layer-forming electric potential difference lower than an electric potential when forming the image on the print medium, forms a combined patch for calibration by the set toner-layer-forming electric potential difference for calibration, so as to adjust the developing-bias potential by measuring a print density of the formed combined patch. The combined patch includes a first patch and a plurality of second patches. The first patch has a width larger than a predetermined value in a peripheral-velocity direction of the photoreceptor and extends with a length equal to or more than the predetermined value in a rotation-shaft direction of the photoreceptor. The plurality of second patches have a width within a range of 0.2 mm to the predetermined value in the peripheral-velocity direction of the photoreceptor, extend with a length equal to or more than the predetermined value in the rotation-shaft direction of the photoreceptor, and are arranged at a predetermined interval in the peripheral-velocity direction of the photoreceptor. The control unit measures the print density of the first patch and the print densities of the second patches to adjust a dot-area rate using the measured values.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
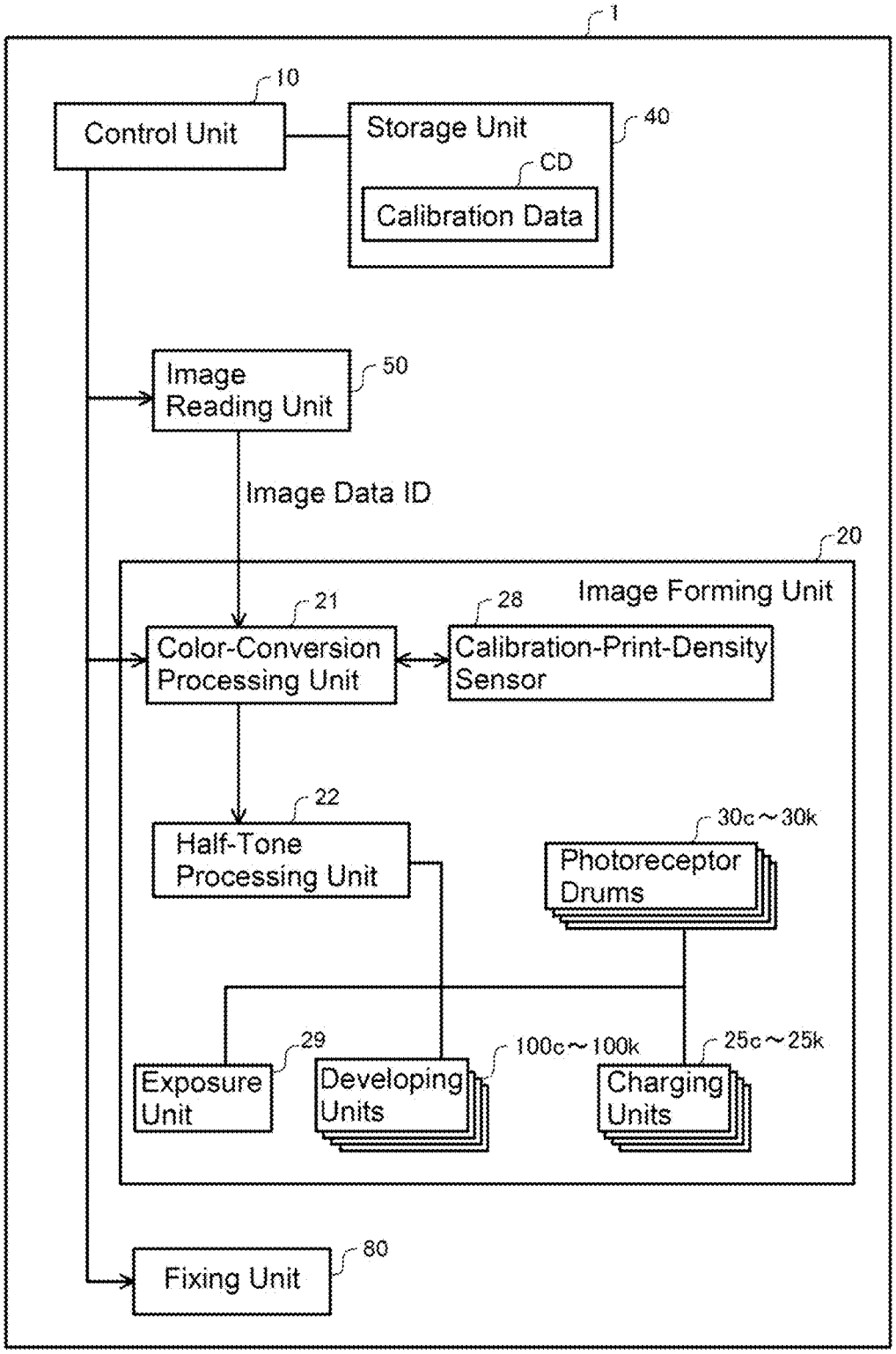
FIG. 1 illustrates a block diagram illustrating a functional configuration of an image forming apparatus according to a first embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes configurations for implementing the disclosure (hereinafter referred to as "embodiment") in the following order with reference to the drawings.

A. First embodiment
B. Second embodiment
C. Modifications

A. First Embodiment

FIG. 1 illustrates a block diagram illustrating a functional configuration of an image forming apparatus 1 according to a first embodiment of the disclosure. The image forming apparatus 1 includes a control unit 10, an image forming unit 20, a storage unit 40, an image reading unit 50, and a fixing unit 80. The image reading unit 50 reads an image from a document and generates image data ID as digital data.

The image forming unit 20 includes a color conversion processing unit 21, a halftone processing unit 22, a calibration-print-density sensor 28, an exposure unit 29, photoreceptor drums (image carriers) 30*c* to 30*k* that are amorphous silicon photoreceptors, developing units 100*c* to 100*k*, and charging units 25*c* to 25*k*. The color-conversion processing unit 21 performs color conversion to convert the image data ID, which is RGB data, into CMYK data. The half-tone processing unit 22 performs a half-tone process on the CMYK data to generate half-tone data of CMYK.

The control unit 10 includes a main storage unit such as a RAM and a ROM, and a control unit such as a microprocessing unit (MPU) or a central processing unit (CPU). The control unit 10 has a controller function related to an interface such as various kinds of I/Os, a universal serial bus (USB), a bus, and other hardware and controls the whole image forming apparatus 1.

The storage unit 40 is a storage device constituted of a hard disk drive, which is a non-transitory recording medium, a flash memory, and similar memory and stores control programs and data for processes executed by the control unit 10.

The storage unit 40, in this embodiment, further stores a CMYK-tone-calibration adjustment patch and calibration data CD for forming a CMYK half patch. The half patch has a dot-area rate less than 100% and is a patch that expresses a solid image (an image with a solid print density). Since the amorphous silicon photoreceptors are employed for the photoreceptor drums 30*c* to 30*k*, a solid image is expressed by a half patch, which will be described later in detail.

The dot-area rate means an area rate that a dot occupies when each dot is assumed to have a preliminarily set area. In practice, for example, since a dot size varies corresponding to a toner-layer-forming electric potential difference $\Delta V$ (described below) between a developing-bias potential $V_{slv}$ and a magnetic-roller potential $V_{mag}$ or similar electric potential difference, the dot-area rate is different from an area rate in an optical aspect. On the other hand, the solid print density means a print density defined as a print density where a print medium appears to be gaplessly covered with dots in an optical aspect.

Figure 2:
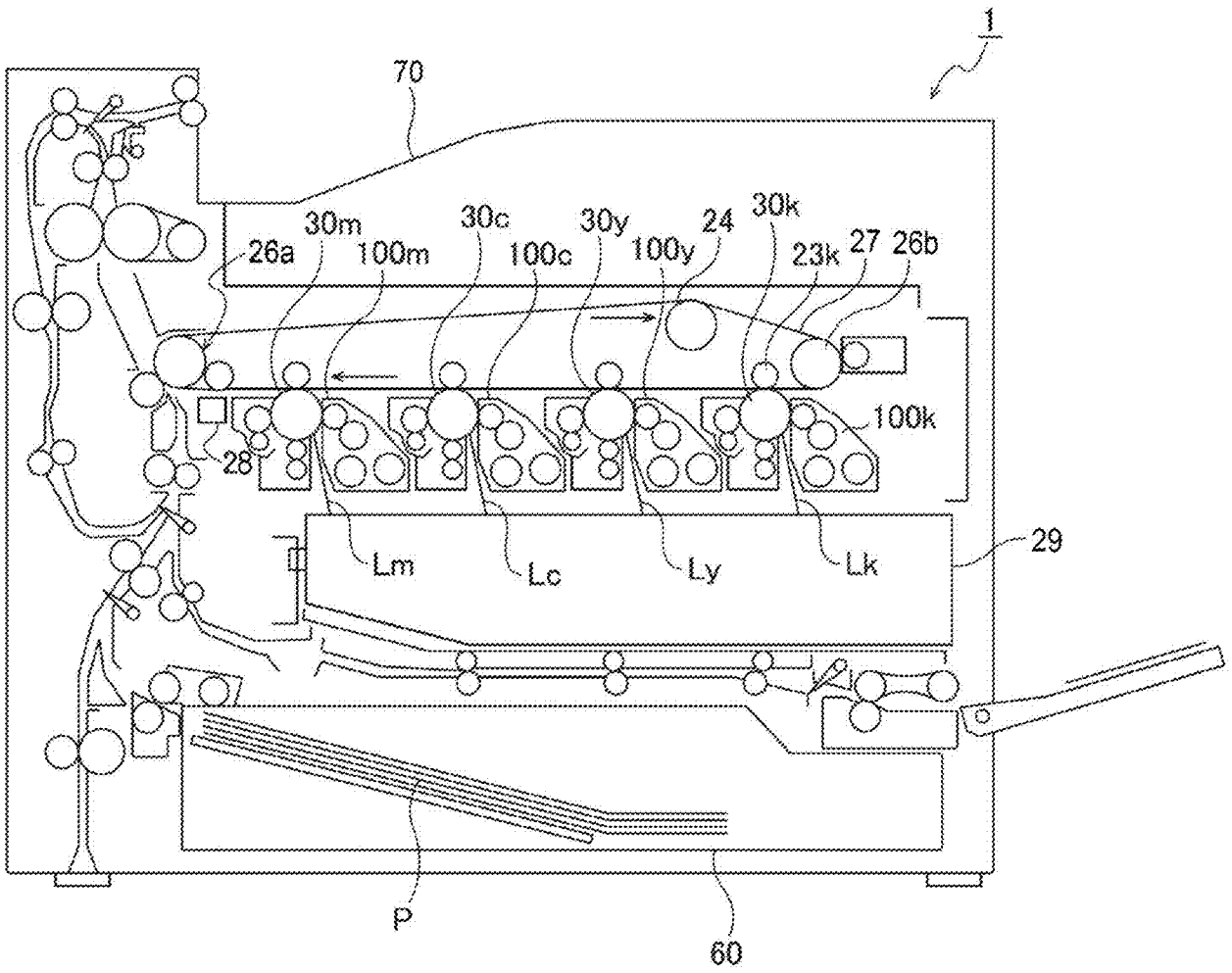
FIG. 2 illustrates a cross-sectional view illustrating an overall structure of the image forming apparatus according to the first embodiment.

FIG. 2 illustrates a cross-sectional view illustrating an overall structure of the image forming apparatus 1 according to the first embodiment. The image forming apparatus 1 in the embodiment is a tandem-type color printer. The image forming apparatus 1 includes the photoreceptor drums (image carriers) 30*m*, 30*c*, 30*y*, and 30*k* arranged in a row corresponding to respective colors of magenta, cyan, yellow, and black, in its housing 70. The developing units 100*m*, 100*c*, 100*y*, and 100*k* are arranged adjacent to the respective photoreceptor drums 30*m*, 30*c*, 30*y*, and 30*k*.

The exposure unit 29 irradiates (exposure) the photoreceptor drums 30*m*, 30*c*, 30*y*, and 30*k* with laser beams Lm, Lc, Ly, and Lk for the respective colors. This irradiation forms electrostatic latent images on the photoreceptor drums 30*m*, 30*c*, 30*y*, and 30*k*. The developing units 100*m*, 100*c*, 100*y*, and 100*k* attach toners to the electrostatic latent image formed on the surfaces of the photoreceptor drums 30*m*, 30*c*, 30*y*, and 30*k* while stirring the toners. This completes a development process, thus ensuring the formed toner images of the respective colors on the surfaces of the photoreceptor drums 30*c* to 30*k*.

The image forming apparatus 1 includes an endless intermediate transfer belt 27. The intermediate transfer belt 27 is stretched by a tension roller 24, a driving roller 26*a*, and a driven roller 26*b*. The intermediate transfer belt 27 is circularly driven by a rotation of the driving roller 26*a*.

For example, the photoreceptor drum 30*k* and a primary transfer roller 23*k* sandwich the intermediate transfer belt 27, and then the intermediate transfer belt 27 is circularly driven. This causes a black toner image on the photoreceptor drum 30*k* to be primarily transferred onto the intermediate transfer belt 27. The same applies to the other three colors of cyan, yellow, and magenta. The intermediate transfer belt 27 has the surface on which the primary transfers are performed and mutually superimposed at predetermined timings, and then a full-color toner image is formed. Then, the full-color toner image is secondarily transferred to a printing paper sheet P supplied from a sheet feed cassette 60, and is fixed on the printing paper sheet P as a print medium by a fixing roller pair 81 of the fixing unit 80.

Figure 3:
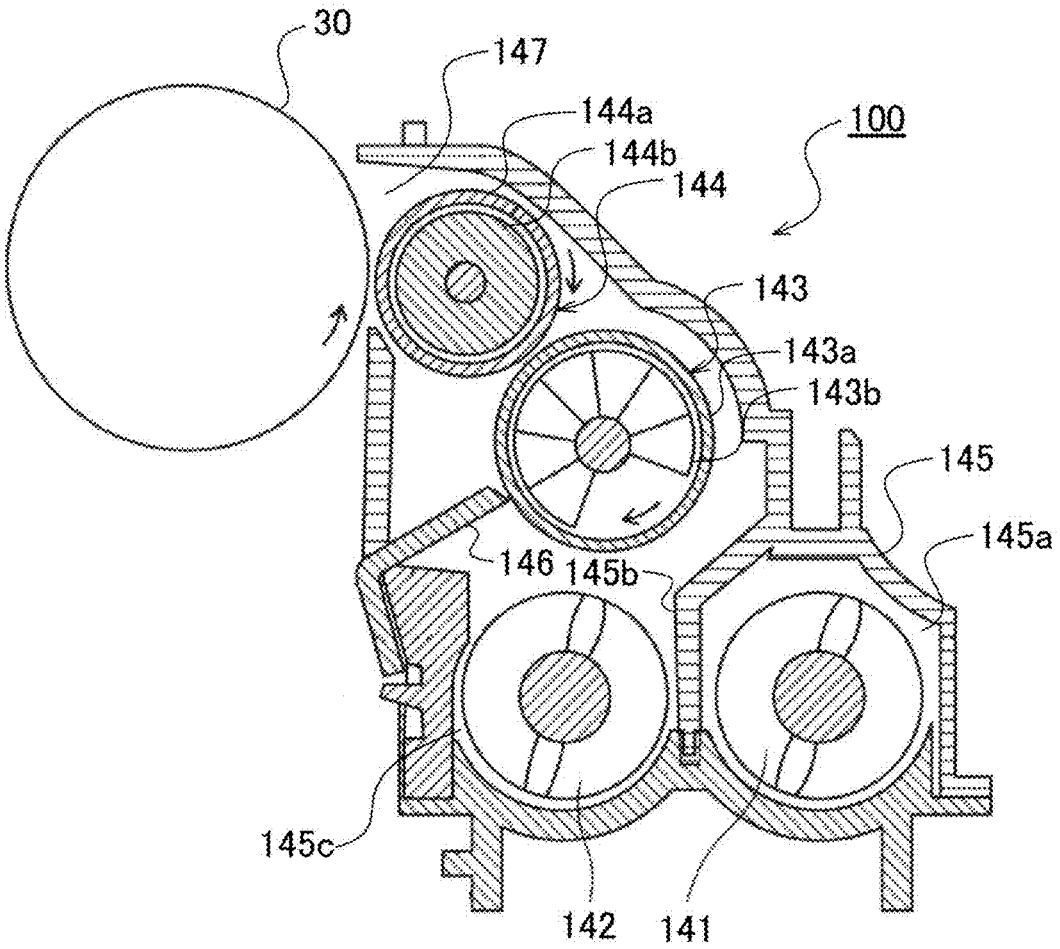
FIG. 3 illustrates a cross-sectional side view illustrating a structure of a developing unit according to the first embodiment.

FIG. 3 illustrates a cross-sectional side view illustrating a structure of the developing unit 100*k* according to the first embodiment of the disclosure. The developing units 100*m*, 100*c*, and 100*y* have the configurations identical to the developing unit 100*k* and are also simply referred to as a developing unit 100. The developing unit 100 includes two stir conveying members 141 and 142, a magnetic roller 143, a development roller (developer carrier) 144, a developing container 145, and a regulating blade 146.

The developing container 145 constitutes an outside of the developing unit 100. In a lower portion of the developing container 145, a partition portion 145*b* is located. The partition portion 145*b* separates an inside of the developing container 145 into a first conveying chamber 145*a* and a second conveying chamber 145*c*. The first conveying chamber 145*a* and the second conveying chamber 145*c* extend in a columnar shape in a direction perpendicular to FIG. 3, house a two-component developer (also simply referred to as developer) made of magnetic carrier and black toner.

The developing container 145 further holds the magnetic roller 143 and the development roller 144. The developing container 145 has an opening 147 that exposes the development roller 144 toward the photoreceptor drum 30 (30*k*).

The two stir conveying members 141 and 142 cyclically move the developer while stirring the developer inside the first conveying chamber 145*a* and the second conveying chamber 145*c*, respectively. The stir conveying member 142, as a magnetic brush, supplies the electrostatically charged developer to the magnetic roller 143. The magnetic roller 143 includes a non-magnetic rotation sleeve 143*a* and a stationary magnet body 143*b* secured inside the rotation sleeve 143*a*. The magnetic roller 143 and the development roller 144 face with a predetermined clearance. The regulating blade 146 adjusts the magnetic brush to a predetermined height preliminarily set.

The development roller 144 includes a rotatable, non-magnetic development sleeve 144*a* and a development-roller-side magnetic pole 144*b* secured to inside of the development sleeve 144*a*. The magnetic-roller potential $V_{mag}$ is applied to the magnetic roller 143. The developing-bias potential $V_{slv}$ is applied to the development roller 144.

In the embodiment, a surface potential of the photoreceptor drum 30 is set to 20 V and forms a development field with the development roller 144. On the other hand, an alternating bias, where a DC potential of 20 V to 80 V as the developing-bias potential $V_{slv}$ and a sinusoidal potential with a frequency of 2 kHz and a peak-to-peak value of 2000 V are superimposed, is applied to the development roller 144. To the magnetic roller 143, a DC potential of 200 V as the magnetic-roller potential $V_{mag}$ is applied during development, and a DC potential of −200 V is applied during non-development.

This causes the time during which the developing-bias potential $V_{slv}$< the magnetic-roller potential $V_{mag}$ (an electric-potential state where the toner is supplied to the development roller 144) to be longer to cause the supply time of the toner to the development roller 144 to be longer during development, and causes the time during which the developing-bias potential $V_{slv}$> the magnetic-roller potential $V_{mag}$ (an electric-potential state where the toner is recovered from the development roller 144) to be longer to cause the recovery time of the toner from the development roller 144 to be longer during non-development.

Furthermore, adjusting the magnetic-roller potential $V_{mag}$ applied to the magnetic roller 143 during development and non-development enables changing the toner-layer-forming electric potential difference ΔV between the developing-bias potential $V_{slv}$ and the magnetic-roller potential $V_{mag}$ during development. This forms a thin toner layer (also simply referred to as a toner layer) with a thickness that corresponds to the toner-layer-forming electric potential difference ΔV between the developing-bias potential $V_{slv}$ and the magnetic-roller potential $V_{mag}$, on the development roller 144.

The development roller 144 attaches the toner to the photoreceptor drum 30 via a facing portion (a development nip) having a predetermined clearance with the photoreceptor drum 30 and then forms a toner image on the surface of the photoreceptor drum 30. The toner image is formed based on an electric potential difference between the electric potential of the electrostatic latent image on the surface of the photoreceptor drum 30 and the developing-bias potential $V_{slv}$ applied to the development roller 144.

The amorphous silicon photoreceptor has a relative dielectric constant about three times higher compared with an organic photoreceptor (OPC) and has a feature that the holdable toner amount is large with respect to a development-contrast potential. In view of this, the amorphous silicon photoreceptor ensures holding more toner than the solid print density, which is ordinarily used. Consequently, using the amorphous silicon photoreceptor in a saturation state holds a toner amount, which exceeds a required amount for the solid print density. Therefore, the embodiment uses the amorphous silicon photoreceptor in a non-saturation state even in the solid print density and uses the amorphous silicon photoreceptor to determine the solid print density by completing the development when approximately all the toner formed on the development roller 144 is developed to the photoreceptor.

Figure 4A:
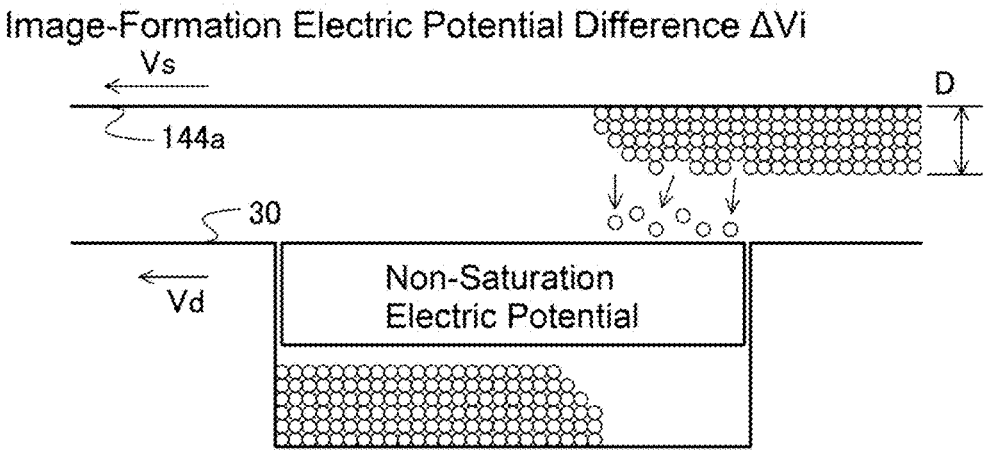
FIGS. 4A to 4C illustrate conceptual diagrams that illustrate and compare development processes according to a comparative example and the first embodiment.
Figure 4B:
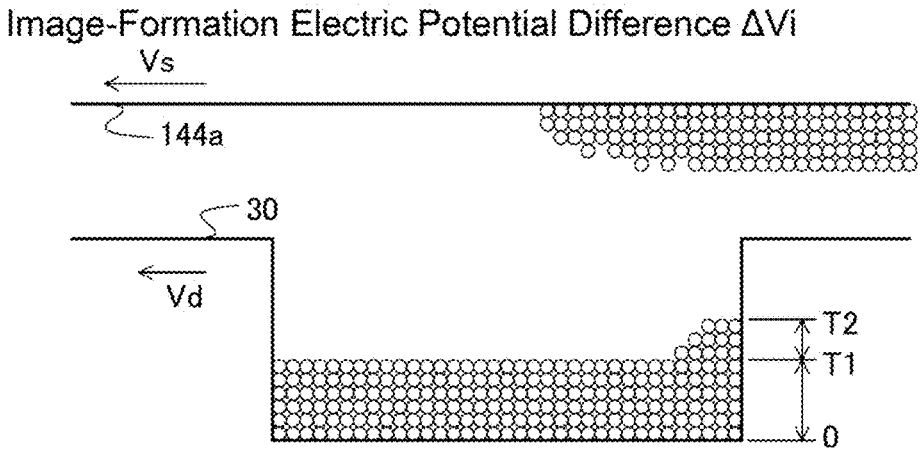
Figure 4C:
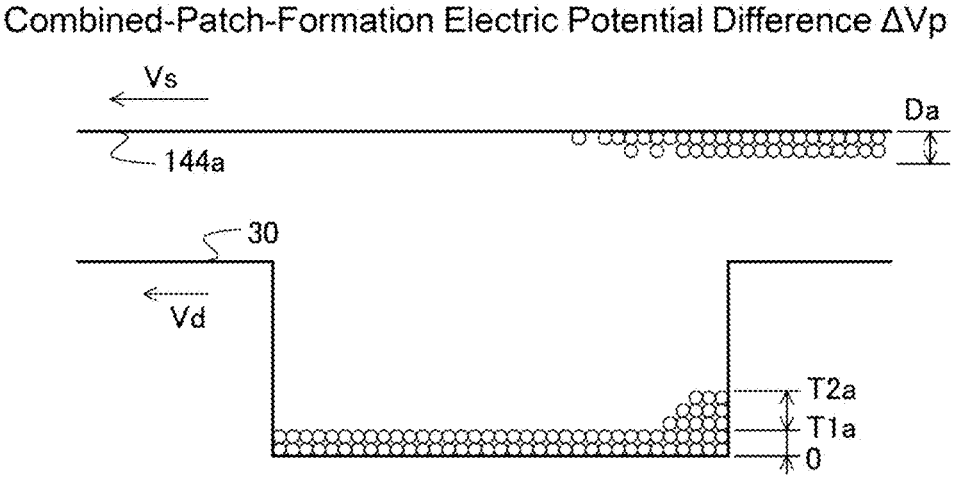

FIGS. 4A to 4C illustrate conceptual diagrams that illustrate and compare the development processes according to a comparative example and the first embodiment. FIG. 4A illustrates a state where the image is formed by a toner-layer-forming electric potential difference ΔVi for image formation (also simply referred to as an image-formation electric potential difference ΔVi) in a front-end portion and a center portion of the image. FIG. 4B illustrates a state where the image is formed by the image-formation electric potential difference ΔVi in the rear-end portion of the image. In this description, the front-end portion, the center portion, and the rear-end portion are based on a running direction of the photoreceptor drum 30, and the front-end portion, the center portion, and the rear-end portion are defined in order from the running direction.

In this embodiment, as illustrated in FIG. 4A, the photoreceptor drum 30 receives supply of the toner from the development roller 144 while neutralizing the electric potential of a latent image. In this case, the development process is configured to complete by the thin toner layer formed on the development roller 144 to be consumed in the non-saturation state, not by the saturation of the electric potential. The thickness of the thin toner layer is set to have a thickness T1 for achieving the highest print density during the solid development in the image formation.

As illustrated in FIG. 4B, the development roller 144 has a peripheral velocity Vs and is configured to form the image while overtaking the photoreceptor drum 30 that has a peripheral velocity Vd. In view of this, in the proximity of the solid rear-end portion during the solid development, the toner-unconsumed surface of the development roller 144 is present. The toner-unconsumed surface overtakes the rear-end portion of the solid latent image in the amorphous silicon photoreceptor 30.

In this case, since the photoreceptor drum 30 as the amorphous silicon photoreceptor is in the non-saturation state, the toner is further developed from the toner-unconsumed surface of the development roller 144. This development actualizes a rear-end accumulation (thickness T2) as a higher solid print density than a preliminarily assumed print density.

FIG. 4C illustrates a state where an image is formed by a toner-layer-forming electric potential difference ΔVp for combined-patch formation (also simply referred to as a combined-patch-formation electric potential difference ΔVp) in the rear-end portion of the image. In this embodiment, the combined-patch-formation electric potential difference ΔVp is set to be 100 V lower than 200 V, which is set for the image formation, by 100 V.

Thus, during the image formation, a toner layer with a thickness D (see FIG. 4A), corresponding to the image-formation electric potential difference ΔVi, is formed on the development roller 144, and during the combined patch, a toner layer with a thickness Da (see FIG. 4C), corresponding to the combined-patch-formation electric potential difference ΔVp, is formed on the development roller 144.

Figure 5:
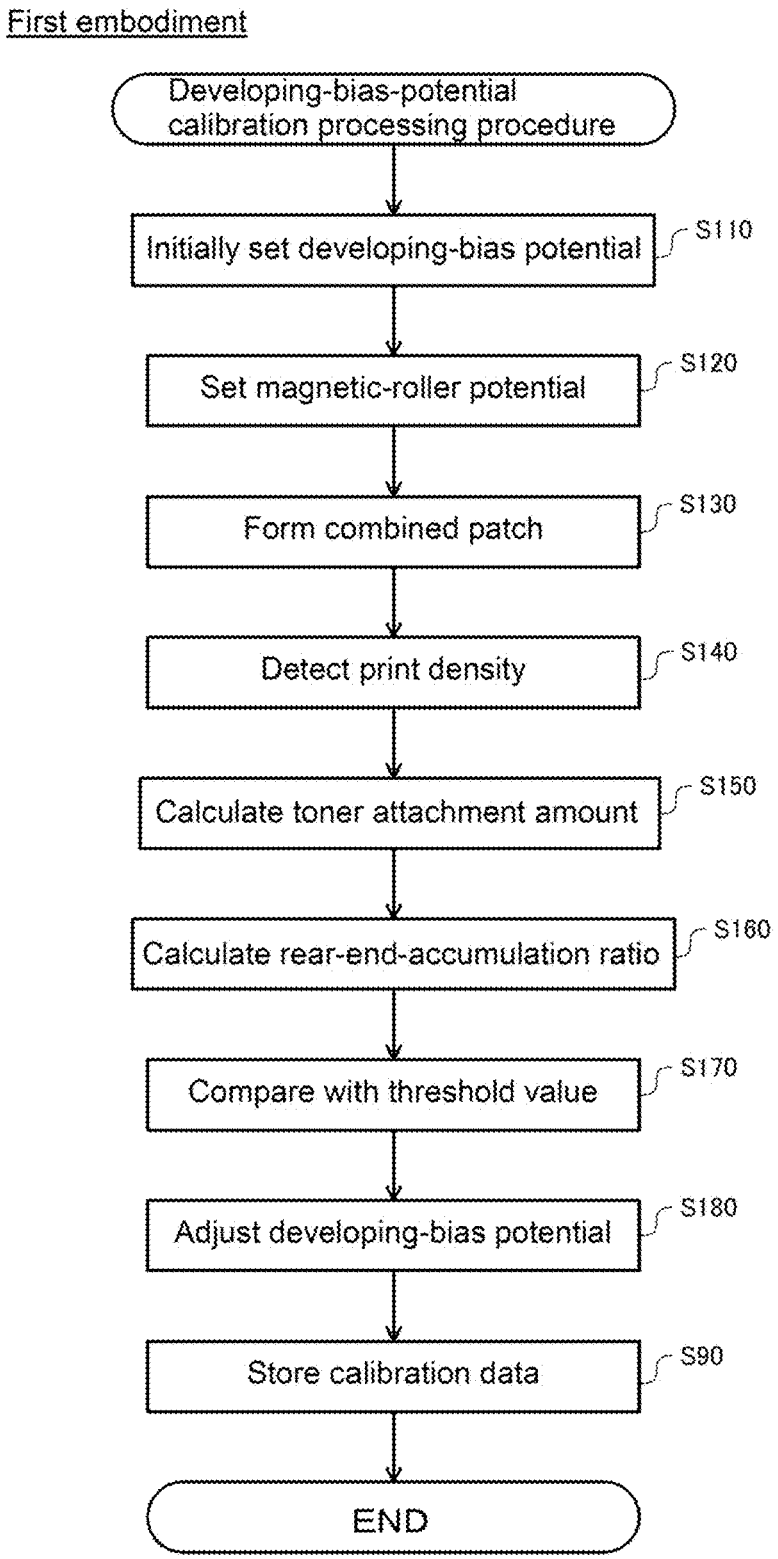
FIG. 5 illustrates contents of a developing-bias-potential-calibration processing procedure of the image forming apparatus according to the first embodiment.

FIG. 5 illustrates contents of a combined-patch-calibration processing procedure of the image forming apparatus 1 according to the first embodiment. The combined-patch-calibration processing procedure is processing for calibrating a solid image density by adjusting the developing-bias potential $V_{slv}$. The developing-bias potential $V_{slv}$ is an electric potential of the development roller 144. The higher the developing-bias potential becomes, the more the toner attachment amount to the photoreceptor drum 30 from the development roller 144 increases, and the darker the image becomes. In this embodiment, assume that the combined-patch-calibration processing procedure is automatically executed during activation in the morning in an office.

At Step S110, the control unit 10 performs an initial setting of the developing-bias potential $V_{slv}$. The initial setting of the developing-bias potential $V_{slv}$ sets, for example, three initial values centered around a final calibration value of a previous day. Specifically, for example, when the final calibration value of the developing-bias potential $V_{slv}$ of the previous day was 60 V, three electric potentials of 50 V, 60 V, and 70 V are set.

At Step S120, the control unit 10 sets the magnetic-roller potential $V_{mag}$ as the electric potential of the magnetic roller 143. The magnetic-roller potential $V_{mag}$ is set to be higher by 100 V than the three developing-bias potential $V_{slv}$ of 50 V, 60 V, and 70 V, such that the combined-patch-formation electric potential difference ΔVp becomes lower by 100 V than the image-formation electric potential difference ΔVi (during development).

At Step S130, the control unit 10 forms the combined patch on the intermediate transfer belt 27. In this embodiment, the combined-patch-formation electric potential difference ΔVp causes the combined patch to be formed in a print density region where the calibration-print-density sensor 28 has good sensitivity (a print density region where a reflection-light amount is large).

Figure 6:
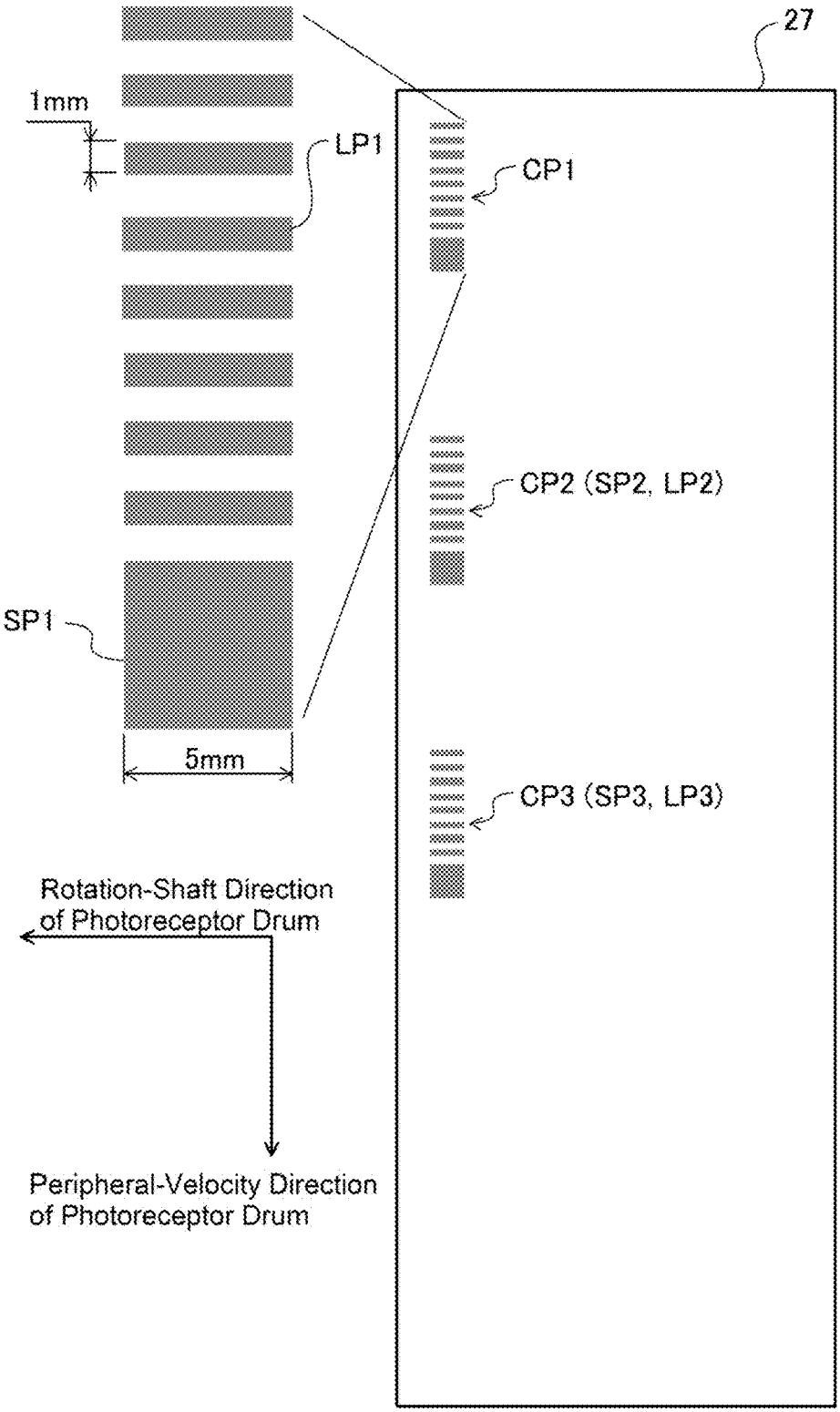
FIG. 6 illustrates an explanatory diagram illustrating an exemplary combined patch according to the first embodiment.

FIG. 6 illustrates an explanatory diagram illustrating an exemplary combined patch according to the first embodiment. A combined patch CP1 is a patch formed with the developing-bias potential 50 V. A combined patch CP2 is a patch formed with the developing-bias potential 60 V. A combined patch CP3 is a patch formed with the developing-bias potential 70 V. The combined patch CP1 is constituted of a solid patch (solid filled patch) SP1 and a ladder patch LP1. The combined patch CP2 is constituted of a solid patch SP2 and a ladder patch LP2. The combined patch CP3 is constituted of a solid patch SP3 and a ladder patch LP3. The combined patches CP1 to CP3 are formed for each toner color and thus totaled 12.

In this embodiment, each of the solid patches SP1 to SP3 has a square shape of 5 mm square, and each of the ladder patches LP1 to LP3 is formed as eight patches having a straight-line shape of 1 mm×5 mm. A count of the patches of the ladder patches LP1 to LP3 is preferably five or more, and more preferably eight or more. The solid patch SP is also referred to as a first patch. The ladder patch LP is also referred to as a second patch.

It is only necessary that the solid patches SP1 to SP3 have a width larger than 2 mm in a peripheral-velocity direction of the photoreceptor drum 30 and extend in a length equal to or more than 5 mm in a rotation-shaft direction of the photoreceptor drum 30. The ladder patches LP1 to LP3 include at least eight straight-line-shaped patches. It is only necessary that each straight-line-shaped patch have a width in a range of 0.2 mm to 2 mm in the peripheral-velocity direction of the photoreceptor drum 30 and extend in a length equal to or more than 5 mm in the rotation-shaft direction of the photoreceptor drum 30. At least eight straight-line-shaped patches are preferably arranged at a preliminarily set interval (for example, at an equal interval identical to the width of the straight-line-shaped patch) in the peripheral-velocity direction of the photoreceptor drum 30 and are preferably arranged at a position approximately identical to a position of the solid patch SP in the rotation-shaft direction of the photoreceptor drum 30.

At Step S140, the control unit 10 measures the patch density for each color (for example, cyan (C)) using the calibration-print-density sensor 28. The calibration-print-density sensor 28 measures six print densities as the print densities of the solid patches SP1 to SP3 and the ladder patches LP1 to LP3 in total. The print densities of the ladder patches LP1 to LP3 are measured as an average value of the measured print densities of the eight patches. On the other hand, in the embodiment, the print densities of the solid patches SP1 to SP3 are measured at the position equal to or more than 2 mm apart from the rear-end portion in the peripheral-velocity direction of the photoreceptor drum 30 to avoid the region of the rear-end-accumulation.

Figure 7A:
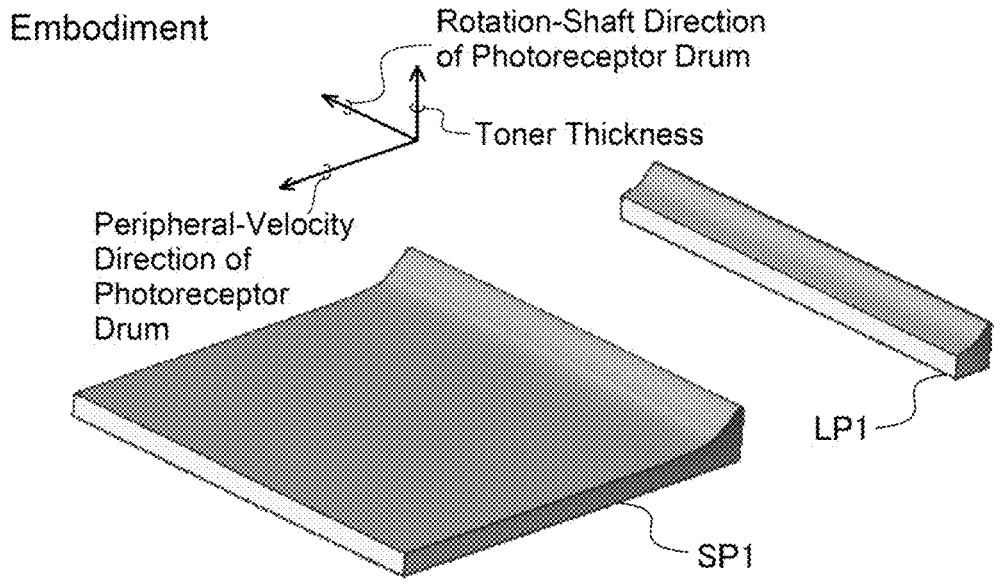
FIGS. 7A to 7C illustrate explanatory diagrams illustrating measuring methods of a reflection-light amount according to the comparative example and the first embodiment.
Figure 7B:
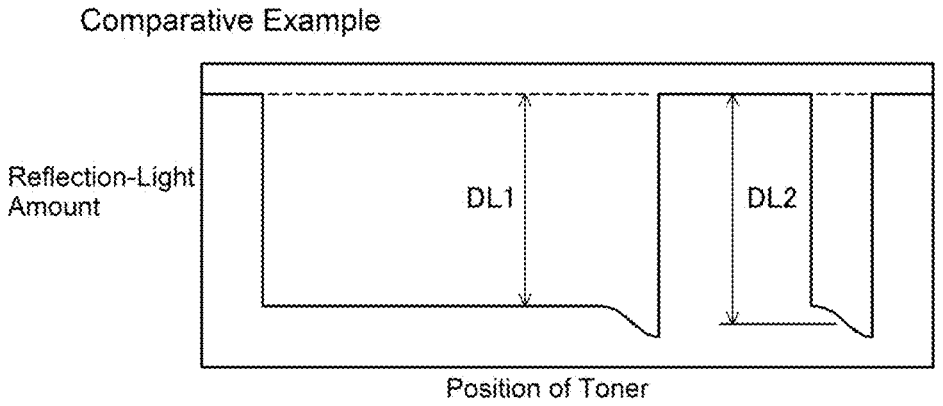
Figure 7C:
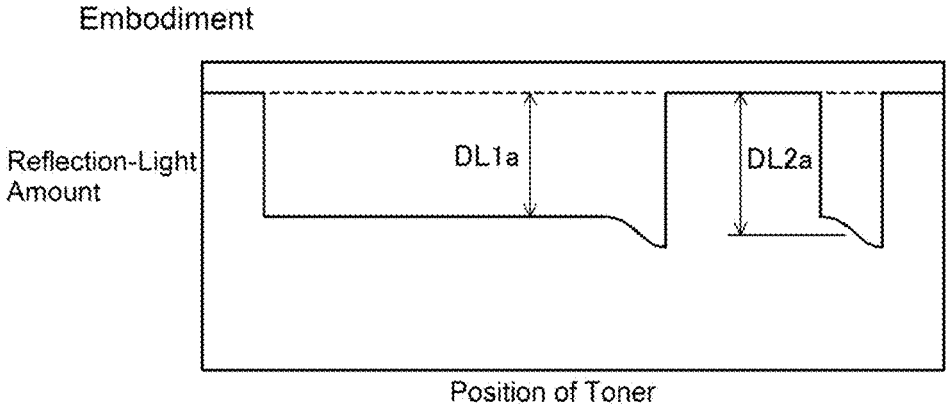

FIGS. 7A to 7C illustrate explanatory diagrams illustrating a measuring method of the reflection-light amount according to the comparative example and the first embodiment. FIG. 7A illustrates a toner attachment state (a stacked state) in the solid patch SP1 and the ladder patch LP1. Both the solid patch SP1 and the ladder patch LP1 have the rear-end portion where the toner layer is raised. The raised-toner layers are the rear-end accumulations. The rear-end accumulations are similarly generated in both the solid patch SP1 and the ladder patch LP1. However, since the ladder patch LP1 is shortly formed in the peripheral-velocity direction of the photoreceptor drum 30, most of the region becomes the rear-end accumulation.

FIG. 7B illustrates the reflection-light amounts of the solid patch SP1 and the ladder patch LP1 in the comparative example (an image-formation setting). Since having the solid print densities, both the solid patch SP1 and the ladder patch LP1 have the significantly low reflection-light amounts, and thus, are the print density regions where the measurement sensitivity of the calibration-print-density sensor 28 is low. The toner layer of the solid patch SP1 generates a light-amount difference DL1 (light-amount reduction) in the region where the rear-end accumulation is not generated. The toner layer of the ladder patch LP1 generates a light-amount difference DL2 (light-amount reduction) in the whole region including the rear-end accumulation.

FIG. 7C illustrates the reflection-light amount of the solid patch SP1 and the ladder patch LP1 in the first embodiment. Although the solid patch SP1 and the ladder patch LP1 are both solid, forming with the combined-patch-formation electric potential difference ΔVp causes the thin toner layer on the development roller 144 to have a thin thickness, thus having received less toner supply from the development roller 144. This increases the reflection-light amount and enables measurement in the print density region where the measurement sensitivity of the calibration-print-density sensor 28 is high.

In the embodiment, the toner layer of the solid patch SP1 generates a light-amount difference DL1*a* (light-amount reduction) in the region where the rear-end accumulation is not formed. The toner layer of the ladder patch LP1 generates a light-amount difference DL2*a* (light-amount reduction) in the whole region including the rear-end accumulation.

In the comparative example, a rear-end-accumulation ratio, which will be described later in detail, has a positive correlation with the light-amount difference DL2/the light-amount difference DL1. On the other hand, in the embodiment, the rear-end-accumulation ratio has the positive correlation with the light-amount difference DL2*a*/the light-amount difference DL1*a*.

Here, as will be appreciated from the forming mechanism of the rear-end accumulation, the difference between the light-amount difference DL2*a* and the light-amount difference DL1*a* does not significantly become smaller than the difference between the light-amount difference DL2 and the light-amount difference DL1. This is because the rear-end accumulation is generated caused by the development roller 144 overtaking of the photoreceptor drum 30 and is not reduced even when the thickness of the thin toner layer on the development roller 144 become thin. Consequently, because the light-amount difference DL1 as a denominator becomes small to the light-amount difference DL1*a*, the light-amount difference DL2*a*/the light-amount difference DL1*a* significantly indicates the influence of the rear-end accumulation with respect to the light-amount difference DL2/the light-amount difference DL1, and thus contributing to the improved-measurement sensitivity.

In the embodiment, the calibration-print-density sensor 28, for example, emits infrared light from an LED (not illustrated), transmits the light through a polarization filter, which transmits only P-wave, to irradiate the P-wave of the infrared light to the patch, and then detects the print density based on a ratio of the P-wave and S-wave of the reflection light detected by a light receiving element. Some calibration-print-density sensors 28 employ a regular reflection method detecting regular reflection light from a patch and others employ a diffuse reflection method detecting diffuse reflection light from a patch. The calibration-print-density sensor 28 may measure, for example, a light amount of reflected red light that has a complementary-color relationship with cyan (C).

At Step S150, the control unit 10 executes a toner-attachment-amount calculation process. In the toner-attachment-amount calculation process, the control unit 10 calculates the toner attachment amount (unit: $g/m^2$) to the intermediate transfer belt 27 based on a preliminarily prepared approximate curve or table from the reflection-light amount measured in the solid patches SP1 to SP3 and the ladder patches LP1 to LP3.

At Step S160, the control unit 10 executes a rear-end-accumulation-ratio calculation process. In the rear-end-accumulation-ratio calculation process, the control unit 10 calculates the rear-end-accumulation ratio in the combined patch CP1 (50 V), the combined patch CP2 (60 V), and the combined patch CP3 (70 V).

The rear-end-accumulation ratio in the combined patch CP1 is calculated as a ratio R1 (=TL1/TS1) of a toner attachment amount TS1 of the solid patch SP1 to a toner attachment amount TL1 of the ladder patch LP1. The rear-end-accumulation ratio in the combined patch CP2 is calculated as a ratio R2 (=TL2/TS2) of the toner attachment amounts of the solid patch SP2 and the ladder patch LP2. The rear-end-accumulation ratio in the combined patch CP3 is calculated as a ratio R3 (=TL3/TS3) of the toner attachment amounts of the solid patch SP3 and the ladder patch LP3.

At Step S170, the control unit 10 compares the ratio R1, the ratio R2, and the ratio R3 with a threshold value Th. Assume that the threshold value Th is 1.2 in the embodiment. The control unit 10 selects the ratio that is smaller than the threshold value Th (1.2) and closest to the threshold value Th among the ratio R1, the ratio R2, and the ratio R3. Specifically, when the ratio R1, the ratio R2, and the ratio R3 are, for example, 1.3, 1.1, and 1.0, respectively, the ratio R2 is selected.

When a ratio smaller than the threshold value Th (1.2) does not exists, or a ratio closest to the threshold value Th is a maximum value, a plurality of combined patches CP1 to CP3 may be formed again, by appropriately readjusting the developing-bias potential $V_{slv}$.

At Step S180, the control unit 10 executes a developing-bias-potential setting process. In the developing-bias-potential setting process, the control unit 10, for example, sets 60 V, which is the developing-bias potential $V_{slv}$ corresponding to the ratio R2, as the developing-bias potential $V_{slv}$ for the image formation.

The developing-bias potential $V_{slv}$ may be set by an interpolation calculation or an extrapolation calculation using data of the ratio R1, the ratio R2, and the ratio R3. In setting of the developing-bias potential $V_{slv}$, a minimum electric potential may be preliminarily set. That is, when an adjusting value of the developing-bias potential $V_{slv}$ becomes equal to or less than the minimum electric potential by the interpolation calculation or similar calculation, the minimum electric potential may be set to be the developing-bias potential $V_{slv}$.

At Step S190, the control unit 10 stores the developing-bias potential $V_{slv}$ (60V) as the calibration data CD in the storage unit 40.

Thus, in the calibration of electrophotography that achieves the solid print density by development with the photoreceptor in the non-saturation state, the image forming apparatus 1 according to the first embodiment ensures the enhanced sensitivity when measuring the patch density with the calibration-print-density sensor 28 as an optical sensor. This enables the image forming apparatus 1 according to the first embodiment to adjust the developing-bias potential $V_{slv}$ with high accuracy.

B. Second Embodiment

Figure 8:
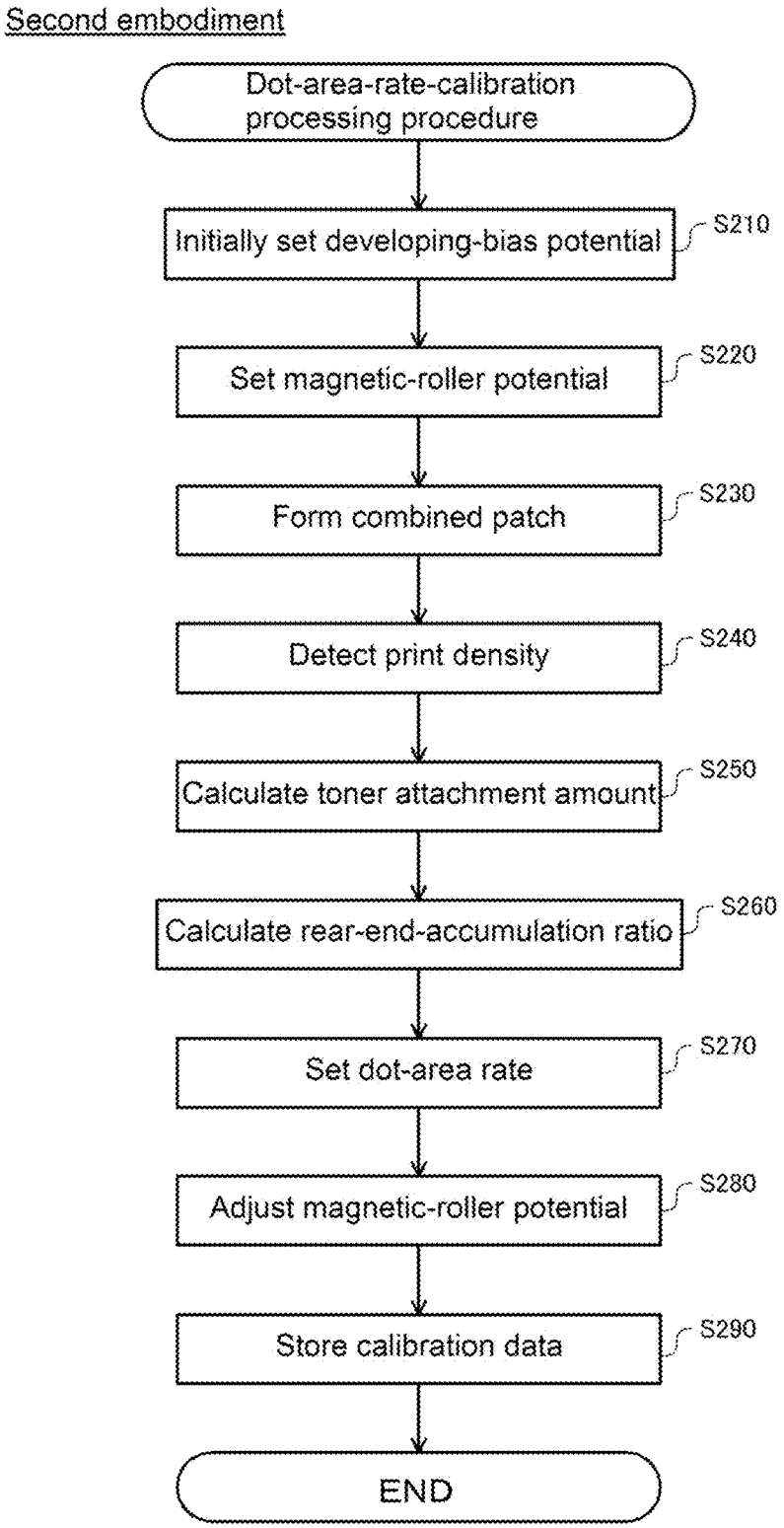
FIG. 8 illustrates contents of a dot-area-rate-calibration processing procedure of an image forming apparatus according to a second embodiment of the disclosure.

FIG. 8 illustrates contents of a dot-area-rate-calibration processing procedure of the image forming apparatus 1 according to a second embodiment. At Step S210, the control unit 10 executes the initial setting of the developing-bias potential $V_{slv}$. In the initial setting, for example, 60 V is set as the final calibration value of the previous day. At Step S220, the control unit 10, similarly to Step S120, sets the magnetic-roller potential $V_{mag}$ as the electric potential of the magnetic roller 143.

At Step S230, the control unit 10, similarly to Step S130, forms the combined patch on the intermediate transfer belt 27. In this embodiment, only a single combined patch is consequently formed. At Step S240, the control unit 10, similarly to Step S140, measures the print density of the combined patch using the calibration-print-density sensor 28.

At Step S250, the control unit 10, similarly to Step S150, executes the toner-attachment-amount calculation process. At Step S260, the control unit 10, similarly to Step S160, executes the rear-end-accumulation-ratio calculation process.

At Step S270, the control unit 10 executes a dot-area-rate setting process. In the dot-area-rate setting process, the dot-area rate is set using the rear-end-accumulation ratio calculated in the rear-end-accumulation-ratio calculation process.

Figure 9A:
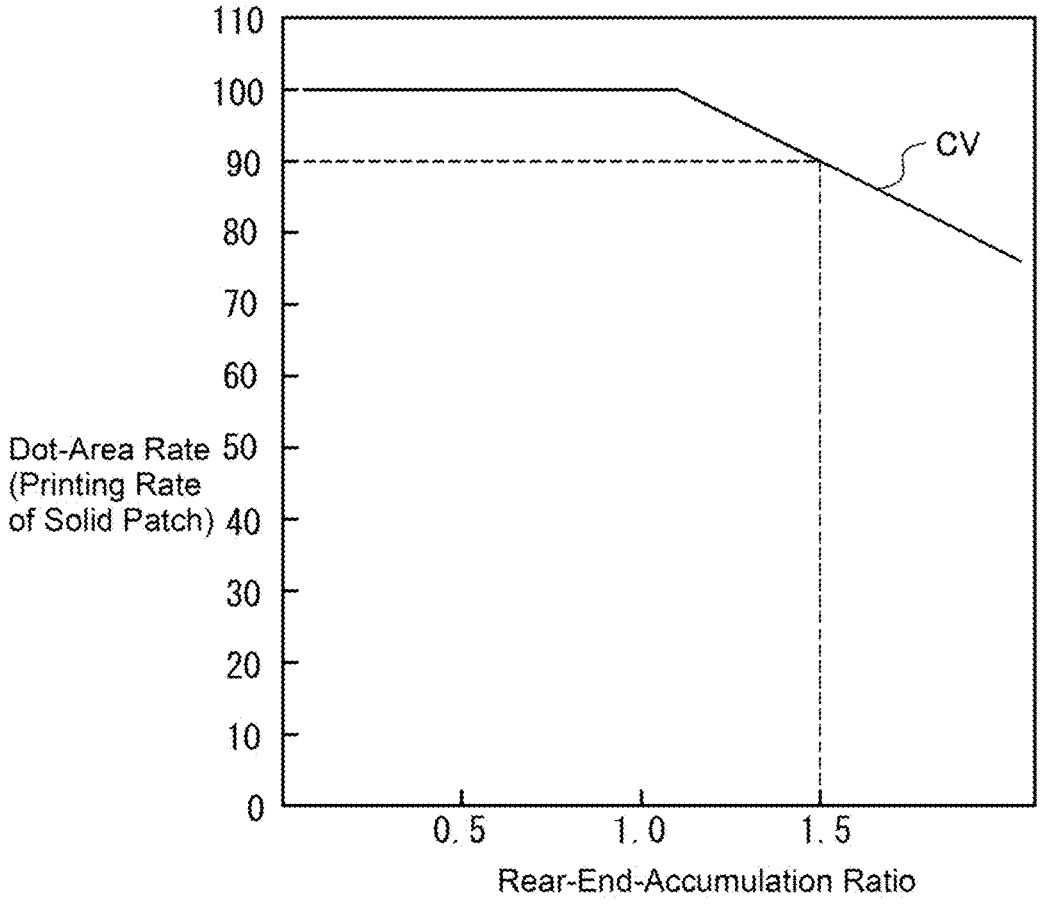
FIGS. 9A and 9B illustrate explanatory diagrams illustrating a setting method of a dot-area rate and a half patch according to the second embodiment.
Figure 9B:
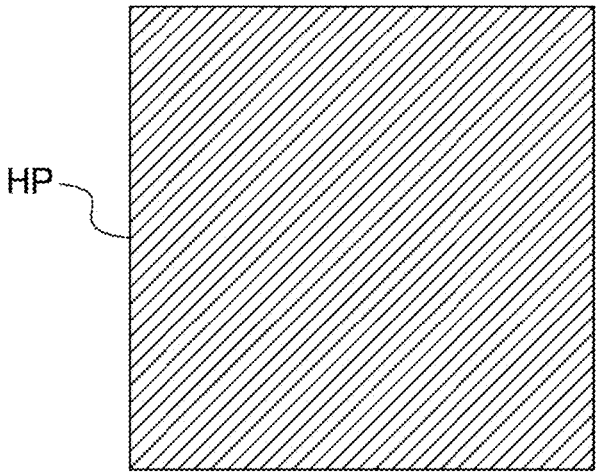

FIGS. 9A and 9B illustrate explanatory diagrams illustrating a setting method of the dot-area rate and the half patch according to the second embodiment of the disclosure. FIG. 9A is a graph illustrating the relationship between the rear-end-accumulation ratio and the dot-area rate (the printing rate of the solid patch). The graph indicates a curved line CV generated based on, for example, an experiment and a simulation and represents a preferred dot-area rate at each rear-end-accumulation ratio. Specifically, the graph indicates that a dot-area rate of 90% is desirable when each rear-end-accumulation ratio is 1.5.

FIG. 9B illustrates a half patch HP. The half patch HP is constituted of oblique screen lines that are densely formed. Since each screen line is constituted of dots formed with toner, strictly speaking, it is not solid in enlarged view. However, each screen line appears to be a solid patch in an ordinary state when a human views a printed matter. Using the half patch HP instead of the solid patch ensures eliminating the problem of the rear-end accumulation. Since each screen line is formed with the print density of the rear-end accumulation portion, the whole patch becomes the uniform print density.

At Step S280, the control unit 10 executes a magnetic-roller-potential adjustment process. The magnetic-roller-potential adjustment process is a process where the control unit 10 applies, for example, 250 V, 300 V, and 350 V instead of DC potential 200 V as the magnetic-roller potential $V_{mag}$ to form the combined patches CP1 to CP3 and adjusts the half patch HP with a dot-area rate of 90% to be the desirable solid print density, similarly to the developing-bias potential $V_{slv}$.

At Step S290, the control unit 10, similarly to Step S190, stores the magnetic-roller potential $V_{mag}$ as the calibration data CD in the storage unit 40. The developing-bias potential $V_{slv}$ may be adjusted again after the adjustment of the magnetic-roller potential $V_{mag}$, or the developing-bias potential $V_{slv}$ may be adjusted instead of the adjustment of the magnetic-roller potential $V_{mag}$.

Thus, in the calibration of the electrophotography that achieves the solid print density by the development with the photoreceptor in the non-saturation state, the image forming apparatus 1 according to the second embodiment ensures adjustment of, for example, the dot-area rate with high accuracy, in a state where the sensitivity in measuring the patch density by the calibration-print-density sensor 28 is enhanced.

C. Modifications

The disclosure is not limited to the above-described embodiment and embodied as the following modifications.

Modification 1

While in the above-described embodiments the solid patch has the square shape of 5 mm square, it is only necessary that the solid patch have a width larger than a predetermined value, which is preliminarily set, and extend with a length equal to or more than a predetermined value in the rotation-shaft direction of the photoreceptor (for example, it may have a square shape of 10 mm square), such that the print density of the region with small influence of the rear-end accumulation is measurable in the peripheral-velocity direction of the photoreceptor. On the other hand, in consideration of, for example, the optical measurement, it is preferred that the ladder patch have a width equal to or more than 0.2 mm, and have a width equal to or less than a predetermined value such that the influence of the rear-end accumulation becomes dominant in the toner thickness.

The toner thickness of the ladder patch is likely to become non-uniform due to the influence of the rear-end accumulation and thus, it is preferred that a plurality of ladder patches be formed to ensure performing statistical processing such as an average value or a median value. Furthermore, it is preferred that the ladder patch be arranged at a position approximately identical to a position of the solid patch in the rotation-shaft direction of the photoreceptor. This forms the patches at identical portions in the axial direction of the photoreceptor drum and thus, even if the variations of the characteristics in the axial direction of the photoreceptor drum exist, thus ensuring the eliminated influence of the variations.

Modification 2

While in the above-described embodiments the above-described respective embodiments use the rear-end-accumulation ratio (division), a difference may be used. That is, the process may be performed similarly to the rear-end-accumulation ratio by subtracting the average toner attachment amount of the solid patch from the toner attachment amount of the ladder patch.

Modification 3

While in the above-described embodiments the amorphous silicon photoreceptor is used, the disclosure is not limited to use of the amorphous silicon photoreceptor. The disclosure is applicable to an image forming apparatus that, in general, reproduces a solid print density in a photoreceptor in a non-saturation state.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus for forming an image on a print medium, comprising:

a photoreceptor;

an exposure unit that exposes the photoreceptor to form an electrostatic latent image;

a developing unit that includes a magnetic roller and a development roller, forms a toner layer with a thickness corresponding to a toner-layer-forming electric potential difference between the magnetic roller and the development roller on the development roller, so as to attach a toner to the photoreceptor from the toner layer based on a developing-bias potential as an electric potential of the development roller and the electrostatic latent image; and a control unit that sets the toner-layer-forming electric potential difference lower than an electric potential when forming the image on the print medium, forms a combined patch for calibration by the set toner-layer-forming electric potential difference for calibration, so as to adjust the developing-bias potential by measuring a print density of the formed combined patch; wherein the combined patch includes a first patch and a plurality of second patches, the first patch has a width larger than a predetermined value in a peripheral-velocity direction of the photoreceptor and extends with a length equal to or more than the predetermined value in a rotation-shaft direction of the photoreceptor, the plurality of second patches have a width within a range of 0.2 mm to the predetermined value in the peripheral-velocity direction of the photoreceptor, extend with a length equal to or more than the predetermined value in the rotation-shaft direction of the photoreceptor, and are arranged at a predetermined interval in the peripheral-velocity direction of the photoreceptor, and the control unit measures the print density of the first patch and the print densities of the second patches to adjust a dot-area rate using the measured values.

2. The image forming apparatus according to claim 1, wherein the control unit adjusts the toner-layer-forming electric potential difference such that the dot-area rate becomes to have a solid print density that is preliminarily set.

3. The image forming apparatus according to claim 1, wherein:

the predetermined value is 2 mm; and the first patch and the plurality of second patches each extend with a length equal to or more than 5 mm in the rotation-shaft direction of the photoreceptor and are each arranged at a position approximately identical to a position in the rotation-shaft direction of the photoreceptor.

4. The image forming apparatus according to claim 1, wherein a count of the plurality of second patches is five or more.

5. The image forming apparatus according to claim 1, wherein the plurality of second patches are arranged at a preliminarily set interval in the peripheral-velocity direction and are arranged at a position approximately identical to a position of the first patch in the rotation-shaft direction.

6. The image forming apparatus according to claim 1, wherein the print density of the first patch is measured at a position equal to or more than 2 mm apart from a rear end portion in the peripheral velocity direction of the photoreceptor.

7. The image forming apparatus according to claim 1, wherein the photoreceptor reproduces a solid print density in a state of a non-saturation state.

8. An image forming method for forming an image on a print medium using a photoreceptor, the image forming method comprising:

exposing the photoreceptor to form an electrostatic latent image;

using a magnetic roller and a development roller to form a toner layer with a thickness corresponding to a toner-layer-forming electric potential difference between the magnetic roller and the development roller on the development roller, so as to attach a toner to the photoreceptor from the toner layer based on a developing-bias potential as an electric potential of the development roller and the electrostatic latent image; and setting the toner-layer-forming electric potential difference lower than an electric potential when forming the image on the print medium, and forming a combined patch for calibration by the set toner-layer-forming electric potential difference for calibration, so as to adjust the developing-bias potential by measuring a print density of the formed combined patch; wherein the combined patch includes a first patch and a plurality of second patches, the first patch has a width larger than a predetermined value in a peripheral-velocity direction of the photoreceptor and extends with a length equal to or more than the predetermined value in a rotation-shaft direction of the photoreceptor, the plurality of second patches have a width within a range of 0.2 mm to the predetermined value in the peripheral-velocity direction of the photoreceptor, extend with a length equal to or more than the predetermined value in the rotation-shaft direction of the photoreceptor, and are arranged at a predetermined interval in the peripheral-velocity direction of the photoreceptor, and the setting includes measuring the print density of the first patch and the print densities of the second patches to adjust a dot-area rate using the measured values.

9. An image forming program for controlling an image forming apparatus including a photoreceptor, an exposure unit, and a developing unit, the exposure unit exposing the photoreceptor to form an electrostatic latent image, the developing unit including a magnetic roller and a development roller, and forming a toner layer with a thickness corresponding to a toner-layer-forming electric potential difference between the magnetic roller and the development roller on the development roller, so as to attach a toner to the photoreceptor from the toner layer based on a developing-bias potential as an electric potential of the development roller and the electrostatic latent image, wherein:

the image forming program causes the image forming apparatus to function as a control unit that sets the toner-layer-forming electric potential difference lower than an electric potential when forming an image on a print medium and forms a combined patch for calibration by the set toner-layer-forming electric potential difference for calibration, so as to adjust the developing-bias potential by measuring a print density of the formed combined patch;

the combined patch includes a first patch and a plurality of second patches;

the first patch has a width larger than a predetermined value in a peripheral-velocity direction of the photoreceptor and extends with a length equal to or more than the predetermined value in a rotation-shaft direction of the photoreceptor;

the plurality of second patches have a width within a range of 0.2 mm to the predetermined value in the peripheral-velocity direction of the photoreceptor, extend with a length equal to or more than the predetermined value in the rotation-shaft direction of the photoreceptor, and are arranged at a predetermined interval in the peripheral-velocity direction of the photoreceptor; and the control unit measures the print density of the first patch and the print densities of the second patches to adjust a dot-area rate using the measured values.

* * * * *